US005802807A

United States Patent [19]

Johnson

[11] Patent Number: 5,802,807

[45] Date of Patent: Sep. 8, 1998

[54] VERSATILE KNOCKDOWN MANUAL BAG FILLING APPARATUS FOR PARTICULATE MATERIAL

[76] Inventor: Melvin C. Johnson, 11749 Wasaukee Rd., Germantown, Wis. 53022

[21] Appl. No.: 827,492

[22] Filed: Mar. 28, 1997

[51] Int. Cl.[6] ..... B65B 67/12

[52] U.S. Cl. ..... 53/255; 37/434; 53/390; 141/391

[58] Field of Search ..... 53/255, 390; 37/434, 37/285, 265; 141/391, 108, 109

[56] References Cited

U.S. PATENT DOCUMENTS

| | | | |
|---|---|---|---|
| 1,183,374 | 5/1916 | Hagerty | 37/434 |
| 2,508,699 | 5/1950 | Welsh | 141/108 |
| 3,602,402 | 8/1971 | Garden | 221/196 |
| 3,751,058 | 8/1973 | Larsen | 37/434 X |
| 4,044,921 | 8/1977 | Caverly | 222/74 |
| 4,302,894 | 12/1981 | Emma | 37/434 |
| 4,585,041 | 4/1986 | Cavanagh | 141/231 |
| 4,917,393 | 4/1990 | Rogers | 53/390 X |
| 5,031,277 | 7/1991 | Coker | 141/108 X |
| 5,123,187 | 6/1992 | Zamaria | 37/285 X |
| 5,215,127 | 6/1993 | Bergeron | 141/10 |
| 5,315,812 | 5/1994 | Germunson | 53/573 |
| 5,353,851 | 10/1994 | Cline | 141/256 |
| 5,575,315 | 11/1996 | Wengert | 53/255 X |
| 5,673,734 | 10/1997 | Hawley | 141/108 |
| 5,687,781 | 11/1997 | Grizz | 141/108 X |

*Primary Examiner*—James F. Coan
*Attorney, Agent, or Firm*—Low and Low

[57] ABSTRACT

A versatile apparatus for quickly and easily filling bags of sand, dirt, or other particulate material which includes a scoop mounted on a lower frame and upwardly extending handles which are braced to the lower frame in use. A latch is provided to detachably secure a bag to the scoop during filling. The entire apparatus can be compactly folded for storage, including relocation of ground wheels and push handles to minimize external size. The invention includes a simplified form for light duty usage.

18 Claims, 5 Drawing Sheets

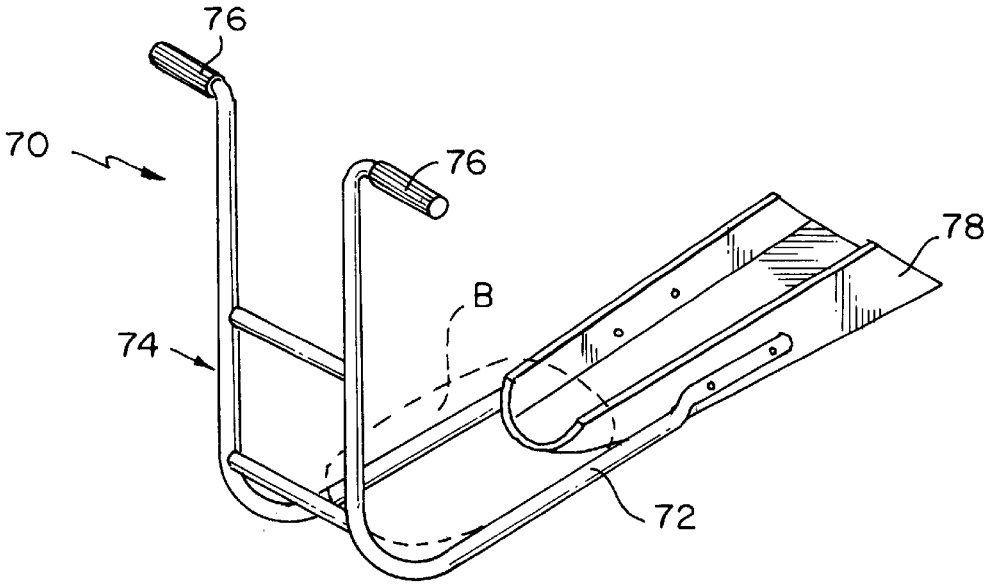
FIG. 10
FIG. 11
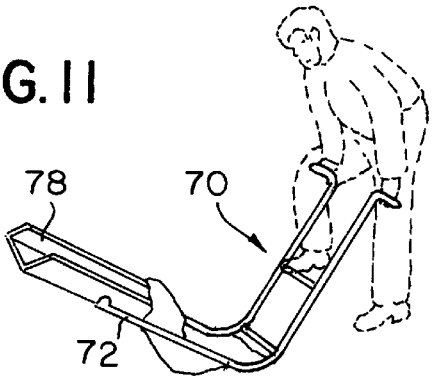
FIG. 12
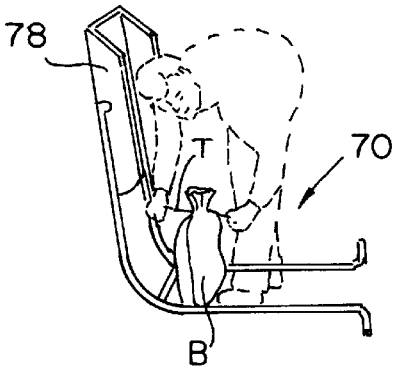
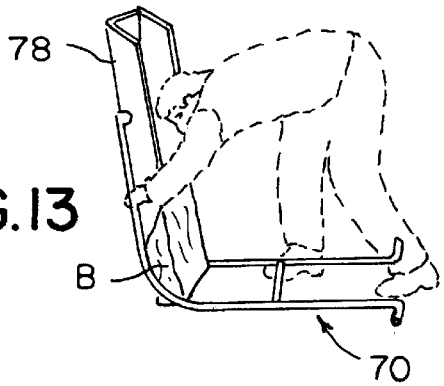
FIG. 13

VERSATILE KNOCKDOWN MANUAL BAG FILLING APPARATUS FOR PARTICULATE MATERIAL

BACKGROUND OF THE INVENTION

There are frequent occasions when it is necessary to fill relatively larger bags made of various plastic or fabric materials with sand, dirt, fertilizer, or other particulate material for use in flood control, or for various purposes around the home, farm, shop, retail stores, or industrial areas. The manual shovelling of sand or any other loose earth or like relatively heavy and dense particulate material is taxing and exceedingly burdensome, especially in an urgent and large scale operation as in filling sandbags as rapidly as possible to build dikes and dams to hold back advancing flood waters in urban, residential, or rural areas.

While various funnels and wire rack bag mouth frames have been employed to facilitate bag loading, the same do not reduce the shovelling load on the bagger or other attendants. In like manner, while various scoop devices may ease the load on the shoveller, the same do not cooperate easily with the flexible bags to be filled. Quite often, adequate bag filling on any reasonable basis of relative speed can not be achieved in the absence of the availability of at least two or three people to assist with the shovelling, bag holding, and filling functions.

An inexpensive, readily portable, and easily stored device is highly desirable to alleviate these problems, and also to be quickly available for use when needed, as in an emergency, or otherwise convenient for ready use.

BRIEF SUMMARY OF THE INVENTION

The present invention embraces such a novel apparatus which is easily used by just one person if necessary to readily fill flexible bags of sand, dirt, fertilizer, etc. with minimum effort and back strain, as well as greatly facilitating bag filling operations at any time. The same is readily transported for use, and is demountable or readily knocked down into a folded and compact relationship of components for convenient storage or transport.

The invention in the preferred embodiment uniquely embraces a foldable frame which is erected for use to a generally L-shape with upstanding handles and a scoop member mounted to a generally horizontally extending elongated lower frame portion. When so unfolded and bolted for use, strut members between the upstanding handles and the lower frame portion are detachably connected to rigidify the apparatus. Preferably, the lower frame portion is provided with a pair of ground wheels generally midway therealong to aid in moving the apparatus over the ground to, from, and into a pile of sand or the like.

The scoop is a shallow elongated U-shaped pan of tapered configuration with a larger mouth at the infeed end to receive the charge of sand or the like, and a somewhat smaller mouth at the other end from which the material is discharged into a bag.

A releasable clamp is provided above the scoop to easily and quickly secure a bag by its mouth to the scoop discharge end, and accommodates bags of differing sizes that may be available.

In addition to the foldable frame, detachable handle grips associated with the upstanding handle members may be placed in a retracted position within the exterior periphery of the overall frame, and in like manner, the ground wheels may be removed and stored within the frame periphery, thereby providing a uniquely compact storage and transport arrangement.

BRIEF DESCRIPTION OF THE DRAWINGS

The invention will be better understood in connection with the accompanying drawings, in which:

FIG. 10 is a perspective view of a modified form of the invention;

FIG. 11 is a perspective view of the modified form of the invention in use filling a bag;

FIG. 12 is a perspective view of the modified form of the invention in use at the time of removing a filled bag; and, FIG. 13 is a perspective view of the modified form of the invention in use at the time of tying a filled bag.

DESCRIPTION OF THE PREFERRED EMBODIMENT

Figure 4:
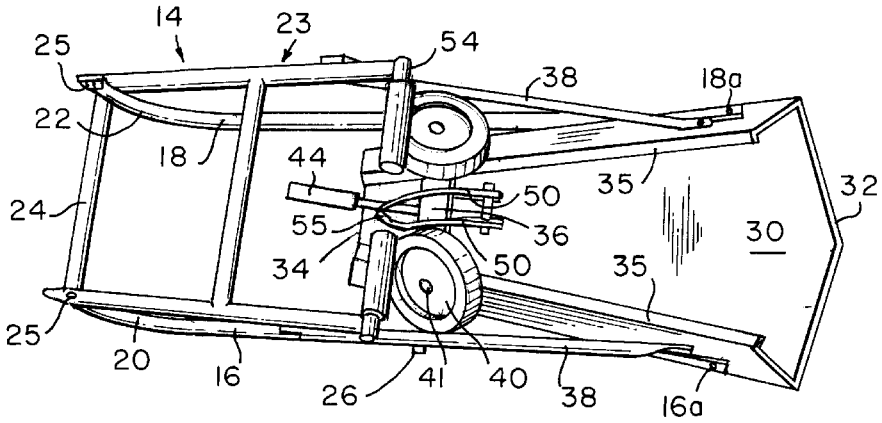
FIG. 4 is a top perspective view of the apparatus in folded position for storage.

Referring to the drawings, the apparatus generally shown at 10 includes in its use position a generally L-shaped frame having a lower elongated frame portion 12 and an upstanding pair of handle members 14. As seen in FIG. 4, the lower frame portion 12 comprises a pair of rigid, preferably metal, tubular members 16, 18 which terminate at their rearward ends in arcuately curved upstanding portions 20, 22. The curve preferably extends through about 90°, and serves as a fulcrum area for the apparatus when in use. An "H"-shaped pair of braced arms or handle members 23 extend upwardly from the curved portions 20, 22 of the lower frame members and are detachably connected thereto as by bolts 25.

The lower frame portion 12 is rigidified as necessary, as by a cross member 24 at the fulcrum area, and also by a rod 26 (FIG. 1) welded to and spanning the tubular members 16, 18 generally midway of the length thereof.

Disposed between the tubular members 16, 18 near their forward ends is a scoop 30 of generally tapered and U-shaped configuration, preferably having a wider and slightly pointed infeed end 32 and a narrower rear discharge end 34. The scoop is preferably provided with short inturned flanges 35 along the length thereof to reduce lateral spillage of the sand or other material.

Scoop 30 is rigidly secured to the frame as by bolts to and between the forward ends of the lower frame tubular members 16, 18, which latter are generally flattened in known manner at their forward ends 16*a*, 18*a* to accommodate the scoop sides. In addition, toward the rear of the scoop, the scoop is affixed in any desired manner to the rigidifying underlying cross rod 26 as by bolts engaging securing flanges on the cross rod (not shown).

A major component of the apparatus is a generally U-shaped brace 36 extending over scoop 30 near the rear thereof. The brace is secured at its depending ends to the lower tubular members 16, 18 as by welding. Adjacent its lower ends on each side, brace 36 is provided with conventional threaded hub members (not shown) to receive conventional axle bolts associated respectively with each of the two wheels 40, whereby the wheels may be detachably secured for use in the position shown in FIG. 1, for example.

Figure 3:
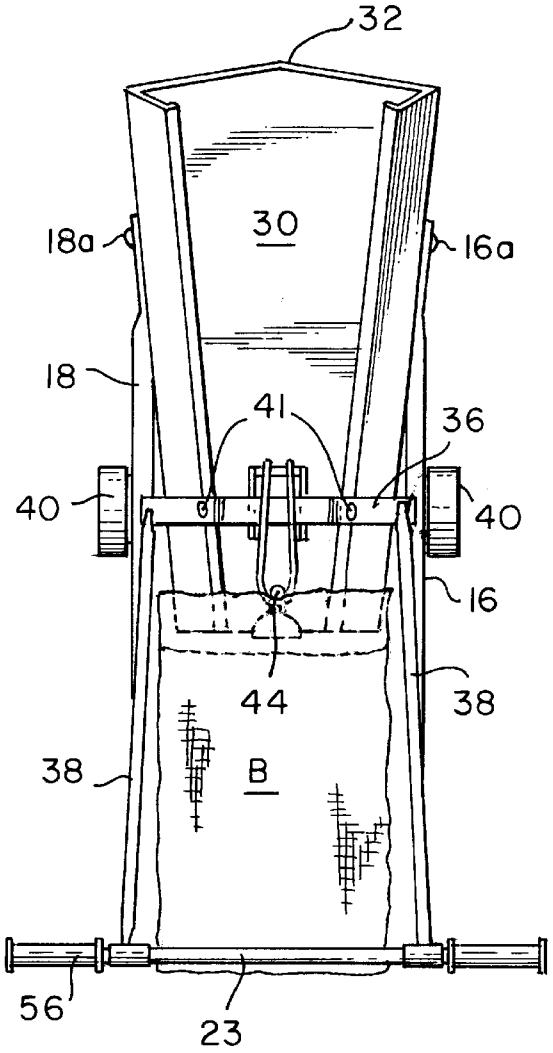
FIG. 3 is a front elevation of the device in the position of FIG. 2.

As part of the storage feature of the apparatus, described more fully hereinafter, the brace 36 is also provided with a second set of threaded hub members 41 near the top of the brace as seen in FIG. 3, whereby the wheels when detached from the frame 16, 18 may be conveniently mounted to the brace 36 for storage as seen in FIG. 4. While threaded hubs are preferred to secure the wheels to the brace without possible loss, obviously other means as studs or pins may be provided to receive the wheels.

Figure 1:
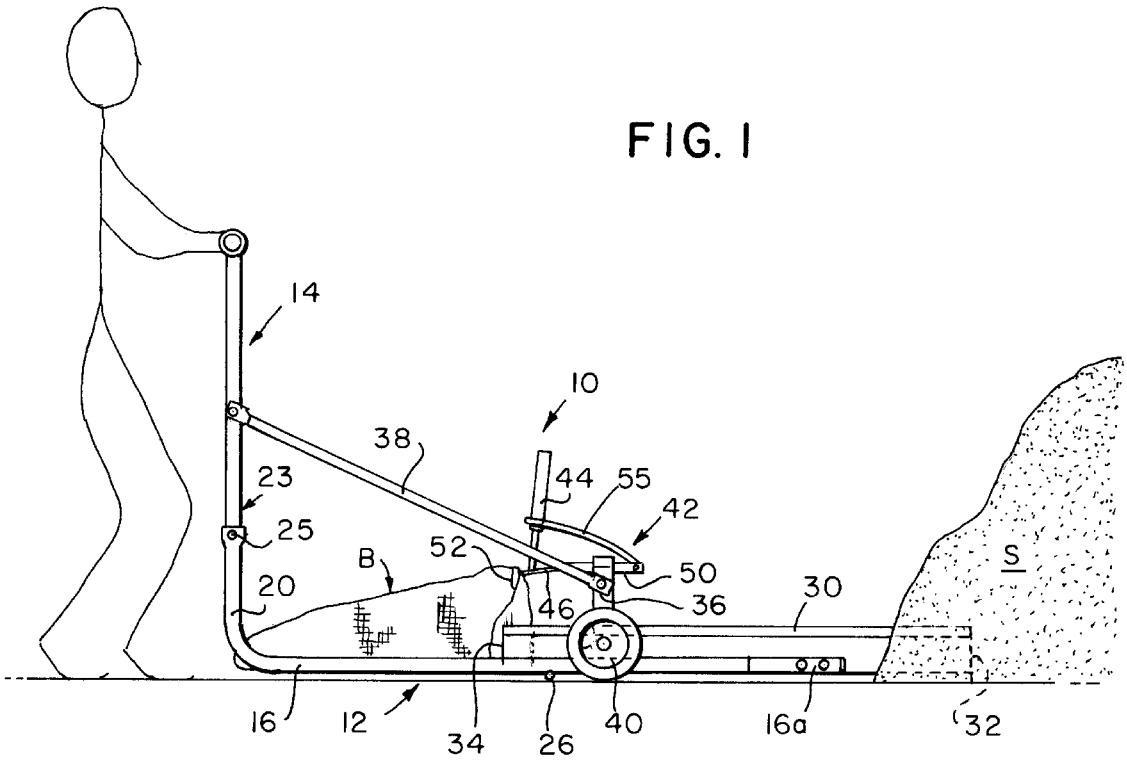
FIG. 1 is a side elevation of the bag filling apparatus shown in use.

Turning again to the upstanding handle arms 23 pivoted to the lower frame, the same are rigidly braced in use by a pair of struts 38, 38 respectively bolted to the upstanding arms 23 at their upper ends and detachably bolted to the U-brace 36 at their lower ends, as seen in FIG. 1. As such, the lower frame 12, the arms 23 and the struts 38 form a rigid generally triangular configuration greatly facilitating use of the apparatus.

Figure 6:
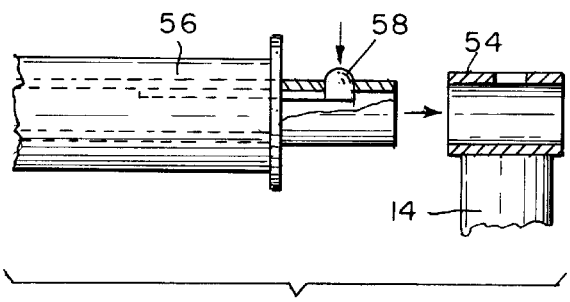
FIG. 6 is an exploded view, partially in section, of a handle grip removed from its adjacent handle member.
Figure 7:
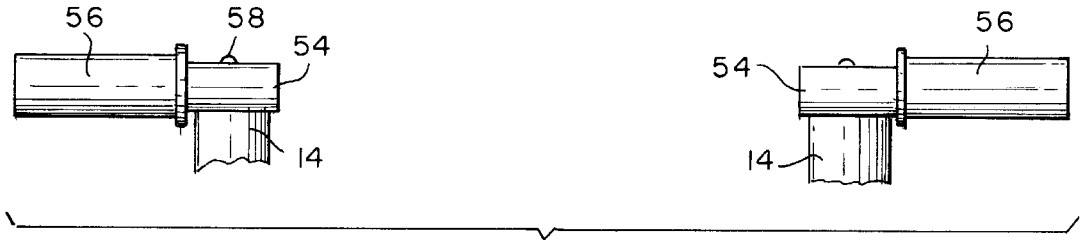
FIG. 7 is a fragmentary view of the two upstanding handle members with the handle grips attached for use.
Figure 8:
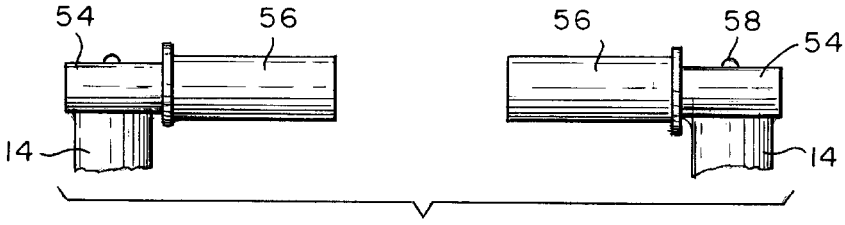
FIG. 8 is a fragmentary view of the two upstanding handle members with the handle grips reversed for storage.

Additionally, as seen in FIGS. 5–8, the upstanding handle members 14 at their upper ends are provided with short tubular elements 54, within which are removably received short handle grips 56. Each grip 56 includes a conventional spring-pressed latch button 58, whereby in use, handle stub pins, the left handle grip being shown in FIG. 6, are inserted into members 54, and detachably latched therein by the spring buttons. In use, the grip members 56 are preferably inserted into the tubular elements 54 so as to extend laterally outwardly of the apparatus as seen in FIG. 7 for comfort of the attendant and easy maneuverability of the apparatus. For storage, as noted hereinafter, the handle grips are reset to face inwardly toward each other as seen in FIG. 8.

Quite importantly, a unique bag spreading and gripping device 42 is cooperatively associated with the U-brace 36 to permit quick fixing of an empty sandbag B or other bag onto the discharge end 34 of the scoop 30. To this end, the spreader 40 includes an upstanding operating handle 44 secured at its lower end to a plate 46. The forward end of plate 46 adjacent the scoop 30 is pivoted thereto by means as a pin or bolt 48 (FIG. 9) extending through a pair of laterally spaced ears 50, 50 attached to the U-brace 36, which ears are on either side of a tubular element (not shown) at the end of plate 46, as in a hinge, and extending transversely to the scoop and frame. Accordingly, handle 44 and plate 46 may be freely swung about its pivot mount at 48. The handle 44 is preferably covered with a friction or gripping surface in the nature of a rubber or leather wrapping for comfort in use as well as to secure the handle in desired position as later set forth.

Plate 46 carries at its rearward end a bag tensioning plate 52 fixed thereto generally at right angles to plate 46, the plate 52 extending laterally of supporting plate 46. The plate 52 preferably has a transversely extending top surface in the shape of a shallow arc to facilitate its engagement with the open mouth of a bag B.

Figure 9:
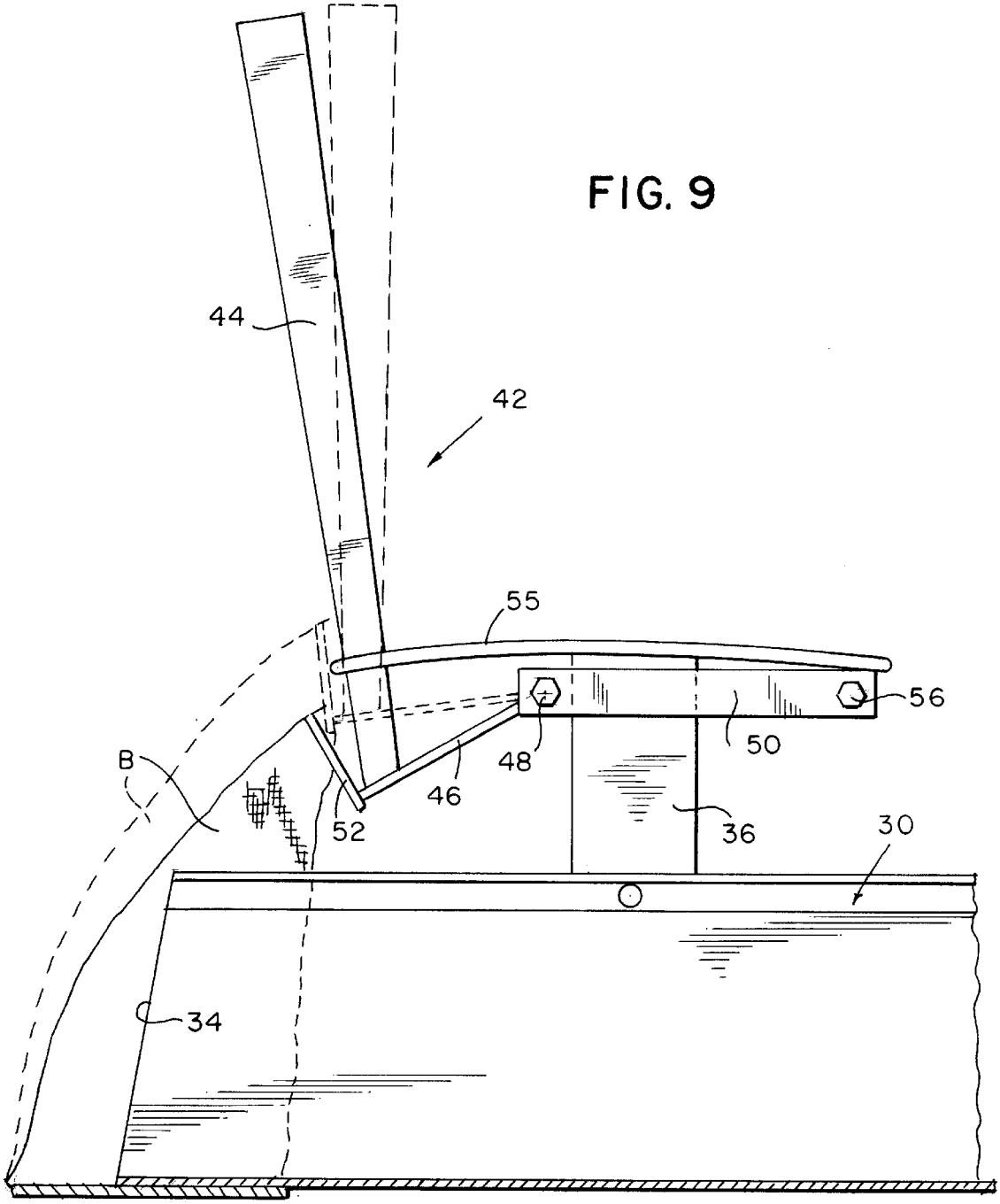
FIG. 9 is an enlarged view of the clamp assembly for detachably holding a bag on the scoop.

As seen in FIG. 9, in the relaxed or lowered full line position, bag tensioning plate 52 cants slightly rearwardly above the rear portion of the scoop 30. In this position, a sandbag B or any like bag is manually fitted about the lower portion of the scoop discharge end 34 as seen in FIG. 9, and the bag mouth is spread to extend over the top edge of bag tensioning plate 52. Thereupon, the handle 44 is swung forwardly as indicated in phantom lines in FIG. 9, thereby swinging the tensioning plate 52 upwardly to draw the open bag mouth tautly about the scoop discharge end.

A friction member is provided to hold the handle 44, and thereby the tensioning plate 52 and the mouth of bag B, in the desired bag spread and tensioned position as shown in FIG. 9. To this end, a loop or "hairpin" of rigid wire 54 as seen in FIGS. 3 and 9 is provided with ears (not shown) at its forward end which are pivoted to a pivot bolt 56, while the closed end of the loop 54 embraces the handle 44. Thus, when the handle is pivoted to the right as seen in FIG. 9 and the bag tensioned, loop 54 is pivoted upwardly and forced along the handle 44 as far as possible. The friction material on the handle prevents the hairpin loop from dropping down, and the handle is held in its relatively forward position to hold the bag mouth open.

Accordingly, the apparatus may be readily erected for use by a single person in attaching the wheels, placing a bag over the scoop rear end 34, spreading and tensioning the same, and with the upstanding handle arms 14 rigidified to the lower frame by brace struts 38, and with a bag B tensioned by the handle arrangement at 42 open over the scoop discharge end 34 as seen in FIG. 1, the attendant may readily push and advance the scoop into a pile of sand S or other particulate material. The material S enters the scoop 30 as far as the attendant may desire, after which, the attendant rocks the apparatus on the fulcrum legs 20, 22 to elevate the scoop and permit the sand or other material charge to flow rearwardly through the scoop 30 into the bag. In this regard, the scoop top flanges 35 aid in confining and guiding the sand into the bag with minimum loss and spillage.

Figure 2:
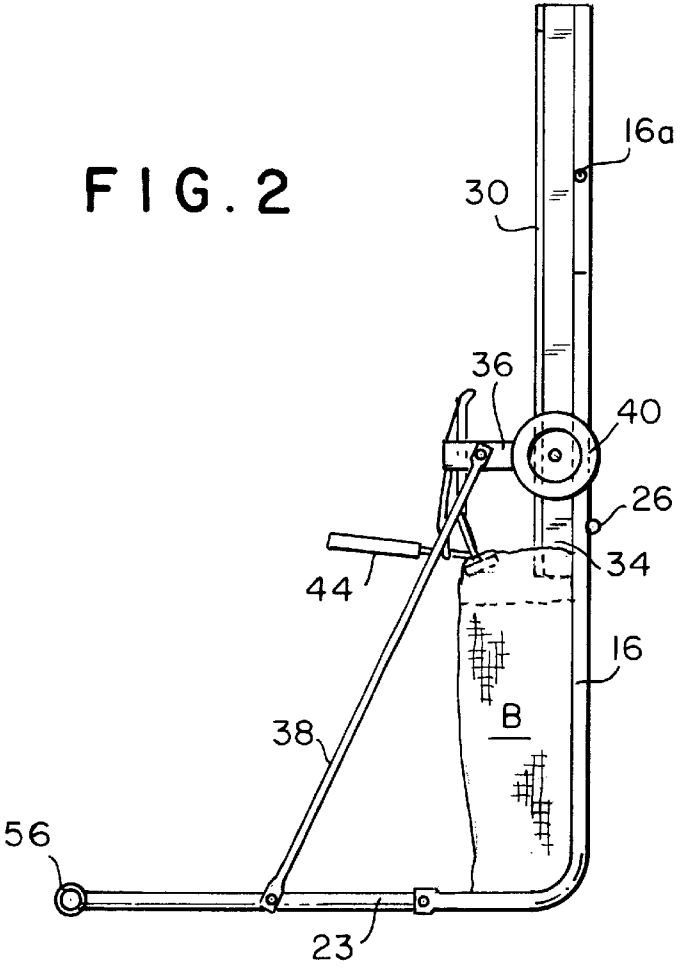
FIG. 2 is a side elevation of the apparatus tilted through 90° to aid removal of a filled bag.
Figure 5:
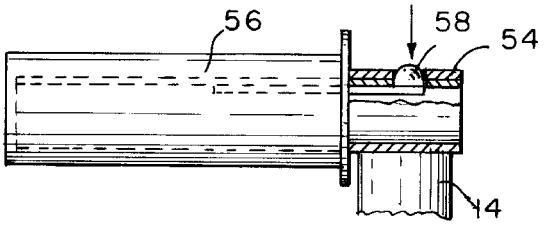
FIG. 5 is a view, partially in section, of a handle grip connected to its adjacent upstanding handle member.

It will be seen that the apparatus can be readily rocked by the attendant from the FIG. 1 position into a 90° reoriented position with the scoop 30 disposed substantially vertically as seen in FIG. 2 for quick delivery of sand or the like from the scoop into the bag with relative ease. Further, the bag can the be quickly released from the scoop by the simple expedient of forcing the loop 54 to pivot down toward the scoop, and freeing handle 44 to swing again rearwardly to release the bag mouth from gripping tension.

Upon removal of the bag filled to the extent desired, a new bag is then placed on the discharge end 34 of the scoop, whether the scoop is vertical or again rolled to horizontal, as may be comfortable or convenient for the attendant.

In the preferred form of FIGS. 1–9, as above indicated, the device may be conveniently partially and compactly configured for storage or transport. In so doing, the wheels 40 are detached from the scoop supporting position of FIG. 1 and repositioned on the brace 36 as seen in FIG. 4 within the periphery of the apparatus. Thereafter, the struts 38 are unbolted or otherwise detached from their connection to the brace 36, and the bolts connecting the same to the upstanding handle arms 23 are loosened, and the bolts 25 connecting the handle arms to the lower frame 16 are also loosened. Thus, the handle arms may be swung downwardly to substantially overlie the rear of the scoop and the struts 38 swung to lie in the same general flattened plane. Finally the handle members themselves which are normally directed outwardly as seen in FIG. 7 in use, are reversed to the FIG. 8 position and thus also with within the general periphery of the stowed unit as seen in FIG. 4.

MODIFIED FORM OF THE INVENTION

FIGS. 10–13 illustrate a lower cost, simplified form of the invention serviceable for light duty work in fillings bags with sand or other particulate material. Thus, the same comprises a single L-shaped frame 70 having a lower ground leg portion 72 and an upright cross-braced handle portion 74. The same are unitary, as compared to the foldable nature of the preferred embodiment.

Fixed outwardly extending handle grips are provided at 76, and a scoop 78 generally similar to the scoop 30 is secured to the lower ground legs 72. As seen, a bag B is manually placed over the discharge end of the scoop and held thereon by friction as the scoop is slid into a pile of sand or the like. Thereupon, the frame is rocked or rolled about the curved fulcrum as seen in FIG. 11, and the bag filled by gravity from the scoop as before. The bag is then removed and tied as before as seen in FIGS. 12 and 13.

While the modified form is shown in its simplest embodiment, features of the principal embodiment may be incorporated therein as desired to enhance its utility, as, for example, the bag tensioning device 42, or ground wheels as at 40.

While I have described several embodiments of my invention, it will be seen that the unique and cooperative features thereof my be modified and take other specific forms within the scope of my invention as defined in the appended claims.

I claim:

1. A manual bag filling apparatus for facilitating the filling of a bag with fluent material comprising, a frame having a pair of handle members graspable by a user and said frame having a lower portion defining a fulcrum area at one end adjacent said handle members, a generally U-shaped scoop mounted to said frame lower portion, said scoop defining a generally planar elongated bottom and a pair of upstanding elongated walls defining a scoop mouth at one end of said scoop and a bag discharge mouth at the other end of said scoop opening toward said fulcrum area, a fulcrum area between said handle members and said lower frame portion, whereby said handle members are swingable to a generally upright position to permit the user to advance the said scoop mouth into a mass of fluent material to charge the scoop, whereupon rocking of said frame about said fulcrum area permits discharge of the scoop contents from the said discharge mouth into a bag positioned thereat, and, a latch apparatus mounted to said frame to releasably tension and secure a bag mouth to said scoop discharge mouth, thereby to facilitate filling the bag from said scoop, said latch apparatus including an arm mounted for pivotal movement on said frame between a first retracted position and a second bag tensioning position for holding a bag adjacent said scoop.

2. The manual bag filling apparatus of claim 1 wherein said fulcrum area of said frame comprises a pair of curved frame sections at the rear of said frame and extending through an arc on the order of 90° and terminating in generally upstanding ends.

3. The manual bag filling apparatus of claim 2 wherein the said upstanding ends of said curved frame sections extend to a distance above said scoop, wherein said handle members when pivoted to storage position overlie said scoop.

4. The manual bag filling apparatus of claim 1 wherein said latch apparatus arm includes a shoe for engagement with the interior of a bag positioned adjacent said scoop and about the discharge mouth thereof to tension the bag mouth about the scoop.

5. The manual bag filling apparatus of claim 4 wherein said latch apparatus includes a clamp to maintain said shoe in bag tensioning relation.

6. The manual bag filling apparatus of claim 1 wherein said latch apparatus includes a brace member mounted to said frame and extending over said scoop, and said arm is pivotally mounted to said brace.

7. The manual bag filling apparatus of claim 1 further including a set of ground wheels rotatably mounted to said frame lower portion to facilitate movement of said apparatus toward and into a mass of fluent material.

8. The manual bag filling apparatus of claim 7 wherein said wheels are detachably mounted to said frame, and said frame is provided with a storage mount for said wheels, said storage mount being disposed above said scoop.

9. The manual bag filling apparatus of claim 1 wherein said handle members are pivotally mounted to said lower frame portion whereby the same may be generally folded over said scoop for compact storage when not in use, and, a rigidifying device to releasably secure said handle members when in upright position for use.

10. The manual bag filling apparatus of claim 9 wherein said rigidifying device includes a detachable strut extending between and connected to said pair of handle members and to said frame lower portion thereby to rigidify the apparatus in use.

11. The manual bag filling apparatus of claim 7 wherein said wheels are mounted to said frame lower portion substantially midway of the length thereof.

12. The manual bag filling apparatus of claim 1 wherein each said handle member includes a detachable grip, and each said handle member includes a connection selectively permitting each said handle either to extend outwardly with respect to said frame to facilitate manipulation, or to extend inwardly within said frame to minimize the exterior dimension of the filling apparatus when in storage.

13. A manual bag filling apparatus for facilitating the filling of a bag with fluent material comprising, a frame having a pair of handle members graspable by a user and said frame having a lower portion defining a fulcrum area at one end adjacent said handle members, a scoop of generally U-shaped cross-section mounted to said frame lower portion, said scoop defining a generally planar elongated bottom and a pair of upstanding elongated walls defining a scoop infeed mouth at one end of said scoop and a bag discharge mouth at the other end of said scoop opening toward said fulcrum area, with said discharge mouth being of lesser width than said scoop infeed mouth, said fulcrum area of said frame including a pair of curved frame sections at the rear of said frame lower portion extending through an arc on the order of 90° and terminating in generally upstanding ends, a pivot connection between said handle members and said lower frame portion, whereby said handle members are swingable to a generally upright position to permit the user to advance the said scoop mouth into a mass of fluent material to charge the scoop, whereupon rocking of said frame about said fulcrum area permits discharge of the scoop contents from the said discharge mouth into a bag positioned thereat, and said handle members are swingable to a lower position generally folded over said scoop for compact storage when not in use, bracing struts to releasably secure said handle members when in upright position for use, and, a bag gripping and tensioning device defining a latch apparatus mounted to said frame to releasably secure a bag mouth to said scoop bag discharge mouth, thereby to facilitate filling the bag from said scoop.

14. The manual bag filling apparatus of claim 13 further including a pair of ground wheels rotatably mounted to said frame lower portion to facilitate movement of said apparatus toward and into a mass of fluent material.

15. The manual bag filling apparatus of claim 14 wherein said latch apparatus includes an arm mounted for pivotal movement on said frame between a first retracted position and a second bag tensioning position for holding a bag adjacent said scoop.

16. The manual bag filling apparatus of claim 15 wherein said latch apparatus arm includes a shoe for engagement with the interior of a bag positioned adjacent said scoop and about the discharge mouth thereof to tension the bag mouth about the scoop.

17. The manual bag filling apparatus of claim 16 wherein said latch apparatus includes an adjustable clamp to maintain said shoe in bag tensioning relation and thereby to accommodate bags of varying mouth sizes.

18. The manual bag filling apparatus of claim 13 wherein said pivot connection is disposed between said pair of handle members and said curved frame sections at the upstanding ends of said curved frame sections.

* * * * *